US010685545B2

(12) United States Patent
Zribi et al.

(10) Patent No.: US 10,685,545 B2
(45) Date of Patent: Jun. 16, 2020

(54) WIDE-AREA CHAMBERLESS POINT SMOKE DETECTOR

(71) Applicant: Carrier Corporation, Jupiter, FL (US)

(72) Inventors: Anis Zribi, Colorado Springs, CO (US); Peter R. Harris, West Hartford, CT (US); Paul Schatz, Bradenton, FL (US); Yan Zhang, Vernon, CT (US); Joseph Anthony Vidulich, Englewood, FL (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/313,182

(22) PCT Filed: May 19, 2015

(86) PCT No.: PCT/US2015/031494
§ 371 (c)(1),
(2) Date: Nov. 22, 2016

(87) PCT Pub. No.: WO2015/179347
PCT Pub. Date: Nov. 26, 2015

(65) Prior Publication Data

US 2017/0206764 A1 Jul. 20, 2017

Related U.S. Application Data

(60) Provisional application No. 62/001,708, filed on May 22, 2014.

(51) Int. Cl.
*G08B 17/103* (2006.01)
*G08B 17/12* (2006.01)

(52) U.S. Cl.
CPC ..... *G08B 17/103* (2013.01); *G08B 17/12* (2013.01)

(58) Field of Classification Search
CPC .... G08B 17/10; G08B 17/103; G08B 17/107; G08B 17/117; G08B 17/12; G08B 17/125; G08B 19/00
(Continued)

(56) References Cited

U.S. PATENT DOCUMENTS 7,286,704 B2 10/2007 Pfefferseder et al.
8,439,503 B2 5/2013 Reichow et al.
(Continued)

FOREIGN PATENT DOCUMENTS

JP 2004-267620 * 9/2004
WO 2011131935 A1 10/2011

OTHER PUBLICATIONS

Notification and Transmittal of the International Search Report and the Written Opinion of the International Searching Authority, or the Declaration; Application No. PCT/US2015/031494; dated Jul. 31, 2015; 13 pages.

*Primary Examiner* — Brian Wilson
(74) *Attorney, Agent, or Firm* — Cantor Colburn LLP

(57) ABSTRACT

Open-chamber smoke detector and detection method. An elecromagnetic emitter emits radiation, a sensor receives the signal after it has travelled through the monitored area and analyses it to determine whether smoke is present by comparison with a reference signal representative of a smoke plume. An alarm condition is signaled when an evolution in the obtained data corresponds to the reference profile within a threshold amount.

14 Claims, 3 Drawing Sheets

(58) Field of Classification Search
USPC ..... 340/627, 628, 629, 630
See application file for complete search history.

(56) References Cited

U.S. PATENT DOCUMENTS

| | | | | |
|---|---|---|---|---|
| 8,620,031 | B2 | 12/2013 | Knox et al. | |
| 2008/0297360 | A1* | 12/2008 | Knox | G01N 21/49 340/628 |
| 2010/0188762 | A1* | 7/2010 | Cook | G02B 27/0927 359/858 |
| 2010/0194574 | A1* | 8/2010 | Monk | G01N 21/53 340/627 |
| 2011/0221889 | A1* | 9/2011 | Knox | G01N 21/53 348/135 |
| 2013/0050466 | A1 | 2/2013 | Cetin et al. | |
| 2013/0286391 | A1 | 10/2013 | Erdtmann | |
| 2013/0286393 | A1 | 10/2013 | Erdtmann et al. | |
| 2014/0235965 | A1* | 8/2014 | Tran | A61B 5/0006 600/301 |

* cited by examiner

WIDE-AREA CHAMBERLESS POINT SMOKE DETECTOR

CROSS REFERENCE TO RELATED APPLICATIONS

This application claims priority to PCT Patent Application No. PCT/US2015/031494 filed May 19, 2015, which claims benefit of the Provisional Application No, 62/001,708 filed on May 22, 2014, the entire contents of which is incorporated herein by reference.

BACKGROUND

Smoke detectors, such as commercial smoke detectors, use infrared light scattering or ionization-based techniques inside a small plastic and metallic chamber with inlets of controlled dimensions to prevent entry of unwanted particles. However, some unwanted airborne particles do make their way into the chamber, causing false alarms. Over time, these particles may also collect at the inlets of the sensor chamber, making it more difficult for smoke particles to diffuse into the chamber.

Smoke detectors are subject to a minimum threshold level of cleanliness. Below this level, maintenance is required. Such maintenance may be mandated by code, regulations, or standards, such as those provided by the National Fire Protection Association (NFPA). Another issue with existing commercial smoke detectors is the time to detection. For smoke detection to occur, the smoke particles have to travel to the detector from the source and enter the sensor chamber. The amount of time this takes is dictated by a variety of factors, such as the flow dynamics of the particles, the fire energy, and the size of the room being monitored.

BRIEF SUMMARY

In one embodiment, a method for monitoring an area includes receiving, by at least one sensor, a first plurality of signals and processing the first plurality of signals to obtain data. The obtained data is compared to a profile corresponding to an evolution of a smoke plume. Based on the comparison, an alarm condition is signaled when an evolution in the obtained data corresponds to the profile within a threshold amount.

Additionally or alternatively, in this or other embodiments a second plurality of signals is emitted by the at least one sensor. The processing of the first plurality of signals is based on the emitted second plurality of signals.

Additionally or alternatively, in this or other embodiments the second plurality of signals includes infrared (IR) light.

Additionally or alternatively, in this or other embodiments the second plurality of signals includes electromagnetic (EM) fields.

Additionally or alternatively, in this or other embodiments the EM fields are non-optical fields.

Additionally or alternatively, in this or other embodiments the first plurality of signals is based on a temperature of one or more entities located in the area.

Additionally or alternatively, in this or other embodiments the at least one sensor does not include a chamber.

Additionally or alternatively, in this or other embodiments a component of the at least one sensor is tuned to discriminate between the smoke plume and an object.

In another embodiment, an apparatus includes memory having instructions stored thereon that, when executed, cause the apparatus to receive a first plurality of signals, process the first plurality of signals to obtain data, compare the obtained data to a profile corresponding to an evolution of a smoke plume, and based on the comparison, signal an alarm condition when an evolution in the obtained data corresponds to the profile within a threshold amount.

Additionally or alternatively, in this or other embodiments the instructions, when executed, cause the apparatus to emit a second plurality of signals. The processing of the first plurality of signals is based on the emitted second plurality of signals.

Additionally or alternatively, in this or other embodiments the apparatus includes at least one light emitting diode (LED) configured to emit second plurality of signals as infrared (IR) light, and wherein the apparatus includes at least one photodiode configured to receive the first plurality of signals.

Additionally or alternatively, in this or other embodiments the second plurality of signals includes electromagnetic (EM) fields.

Additionally or alternatively, in this or other embodiments the EM fields adhere to Wi-Fi® standards.

Additionally or alternatively, in this or other embodiments the first plurality of signals is based on a temperature of the smoke plume.

Additionally or alternatively, in this or other embodiments the instructions are executed by at least one logic device.

Additionally or alternatively, in this or other embodiments the instructions are executed by a plurality of logic devices arranged as a pipeline.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
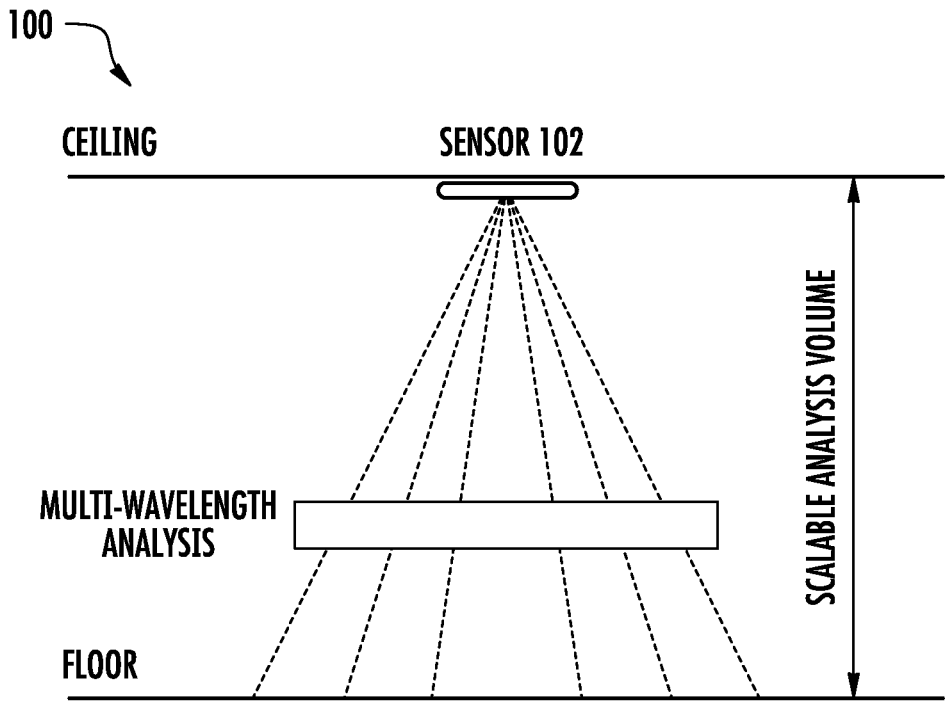
FIG. 1 is a diagram illustrating an exemplary system for detecting smoke via the use of infrared light and time of flight data.

It is noted that various connections are set forth between elements in the following description and in the drawings (the contents of which are included in this disclosure by way of reference). It is noted that these connections in general may be direct or indirect and that this specification is not intended to be limiting in this respect. In this respect, a coupling between entities may refer to either a direct or an indirect connection.

Exemplary embodiments of apparatuses, systems, and methods are described that provide alternatives to detecting smoke based on light scattering or absorption within a physically defined chamber. Embodiments may include one or more emitters that may emit one or more signals, and one or more detectors that may be configured to detect the existence or location of smoke or smoke plumes based on the emitted signal(s). In some embodiments, the emitters and detectors may be operative based on infrared (IR) light and/or electromagnetic (EM) fields. In some embodiments, the EM fields may include non-optical fields or those fields that are outside of a range of (visible) light.

In some embodiments, a sensor may monitor for changes in thermal gradients located within the sensor's range. Temperature data may be analyzed, potentially based on one or more parameters (e.g., spatial, temporal, temperature) to detect the existence or location of smoke or smoke plumes.

Referring now to FIG. 1, a system 100 in accordance with one or more embodiments is shown. The system 100 may include one or more sensors 102. In the embodiment shown in FIG. 1, the sensor 102 is mounted to a ceiling of an area that is monitored. The area may correspond to a room, such as a room on the order of a few square meters.

The sensor 102 may include one or more emitters that may project beam(s) of IR light into the area. The emitters may include a light emitting diode (LED). The sensor 102 may include one or more detectors that measure and track the location of smoke or smoke plumes based on the emitted IR light. In some embodiments, the detection of smoke may be based on a time of flight of photons. The detectors may include a photodiode to convert received light into a current or voltage.

In some embodiments, the emitter(s) and/or detector(s) may be fixed in terms of their configuration. For example, the emitters may be configured to emit light at a fixed angle. The detectors may be configured to receive light (e.g., scattered light), potentially as a function of the emitted light, at a fixed angle or position.

The detectors may be configured to detect scattered light as a function of color, wavelength, or frequency. For example, the detector may be tuned in accordance with a wavelength and frequency, such that smoke may be detected. The tuning may be used to provide an ability to distinguish smoke from other entities or objects, such as bugs and other ubiquitous particles. The tuning may be a function of the wavelength of IR light projected by the emitter(s). Accordingly, a multi-wavelength analysis algorithm may be provided in some embodiments.

In some embodiments, the sensor 102 may include electronic or software filters that may discriminate between ambient light modulation and real smoke-induced signals. The filtration may reject signals caused by ambient light and may allow signals caused by smoke scattering or obscuration to pass. Measured signals may be conditioned and processed, at which point an alarm condition may be signaled if the measured or detected smoke exceeds a threshold.

Figure 2:
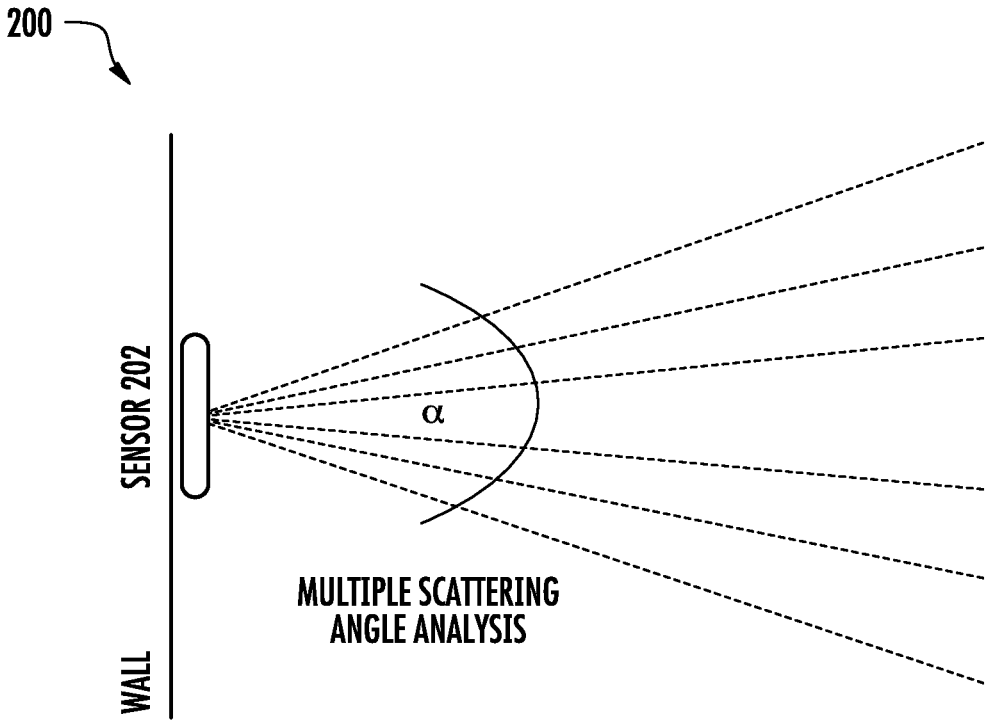
FIG. 2 is a diagram illustrating an exemplary system for detecting smoke via the use of infrared light and time of flight data.

Referring to FIG. 2, a system 200 in accordance with one or more embodiments is shown. The system 200 may include one or more sensors 202. In the embodiment shown in FIG. 2, the sensor 202 is mounted to a wall of an area (e.g., a room) that is monitored. The sensor 202 may perform functions similar to those described above with respect to the sensor 102, and may include components or devices similar to those described with respect to the sensor 102. Accordingly, a complete (re)description of the sensor 202 is omitted for the sake of brevity.

Figure 3:
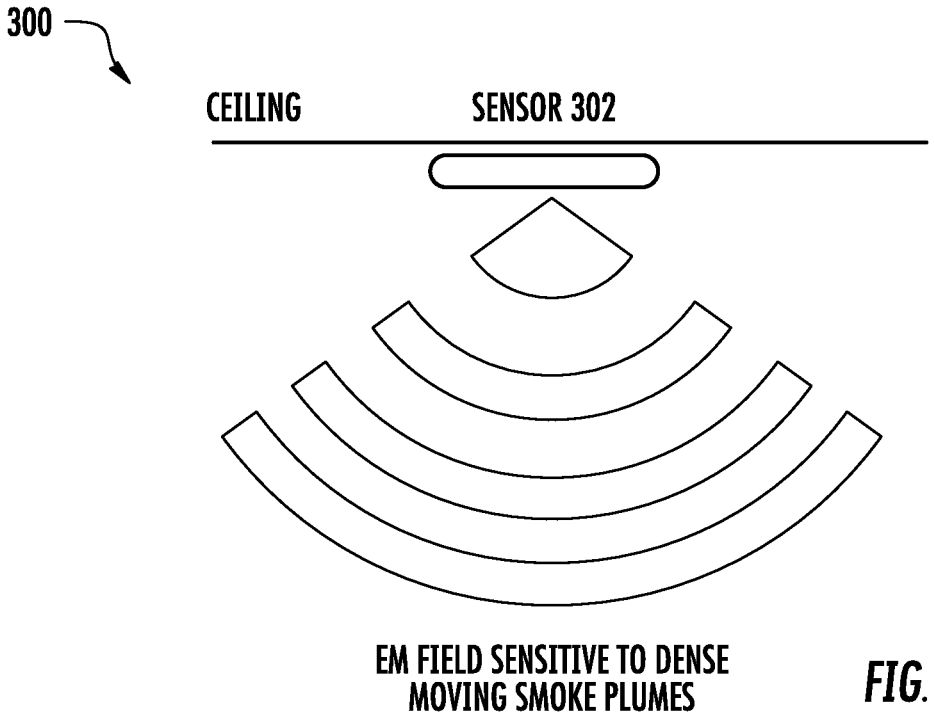
FIG. 3 is a diagram illustrating an exemplary system for detecting smoke via the use of an electromagnetic field.

Referring to FIG. 3, a system 300 in accordance with one or more embodiments is shown. The system 300 may include one or more sensors 302. In the embodiment shown in FIG. 3, the sensor 302 is mounted to a ceiling of an area (e.g., a room) that is monitored.

The sensor 302 may use projected EM fields to extend the sensing range beyond that of a traditional smoke chamber. The projected EM field may register disturbances due to sufficiently dense smoke plumes in motion that enter the EM field's sensitivity region. Based on advances in low-power Wi-Fi® technology for motion detection at longer ranges (even behind walls), Wi-Fi® technology may also be used for the detection of dense plumes in motion at reduced ranges. While the embodiment described herein utilizes Wi-Fi® technology, it is to be appreciated that the use of Blue-Tooth® or other wireless communication technologies are contemplated within the scope of the present disclosure.

One or multiple EM emitters may project into a confined area or space. Smoke plumes in motion may be detected by one or multiple EM detectors in conjunction with the emitter(s). The emitter(s) and/or the detector(s) may be included in the sensor 302.

The sensor 302 may include electronic or software filters and algorithms which enable the sensor 302 to discriminate between solid objects (e.g., bugs) and real smoke plume-induced signals. Measured signals may be conditioned and processed, at which point an alarm condition may be signaled if the measured or detected smoke exceeds a threshold.

In an embodiment, the sensor 302 includes two emitters and one detector. During a calibration task or background task, the two emitters may emit EM fields that interfere with one another such that a reference signal level in the detector is established. In some embodiments, the reference signal level may be selected such that it corresponds to a zero or null value. Next, when objects or smoke plumes are present in the area being monitored, the signal(s) detected by the detector may be different from the reference signal level. In this manner, a comparison may be made between the reference signal level and subsequent detected signals to determine whether a smoke plume is present. This arrangement does not require a direct line of sight between emitter and receiver, which may be located within the same housing.

Figure 4:
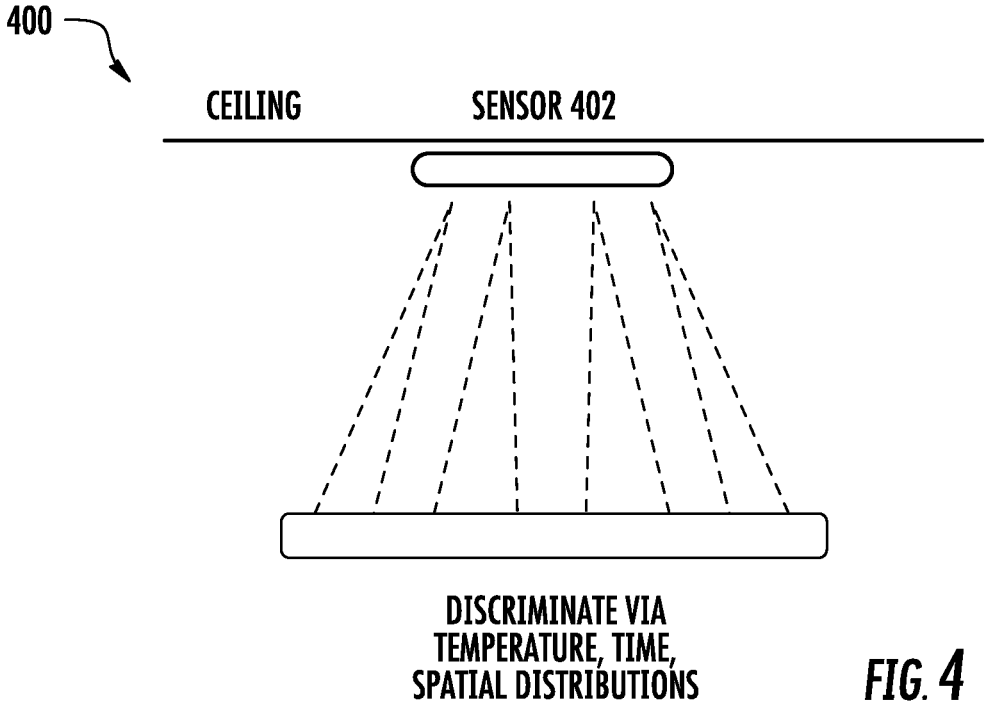
FIG. 4 is a diagram illustrating an exemplary system for detecting smoke via the use of a pyrometer sensor.

Referring to FIG. 4, a system 400 in accordance with one or more embodiments is shown. The system 400 may include one or more sensors 402. In the embodiment shown in FIG. 4, the sensor 402 is mounted to a ceiling of an area (e.g., a room) that is monitored.

The sensor 402 may include a multi-element pyrometer to detect characteristic spatial, temporal, and temperature signatures of smoke plumes. A detection range may extend beyond that of a traditional smoke point detector. A single sensor 402 may monitor an area or space for changes in the thermal gradients within the sensor 402's range.

An algorithm may be executed by the sensor 402 to analyze temperature data over time to determine if the data is indicative of a smoke plume. The number of elements or pixels included in the pyrometer may be selected so as compare detected data to smoke plume profiles or characteristics. The algorithm may discriminate various observed signal responses from the sensor 402 (such as smoke plumes, people, dust plumes, etc.) by comparing characteristics of smoke plumes with those of nuisance sources. Measured signals may be conditioned and processed, at which point an alarm condition may be signaled if the measured or detected smoke exceeds a threshold.

Figure 5:
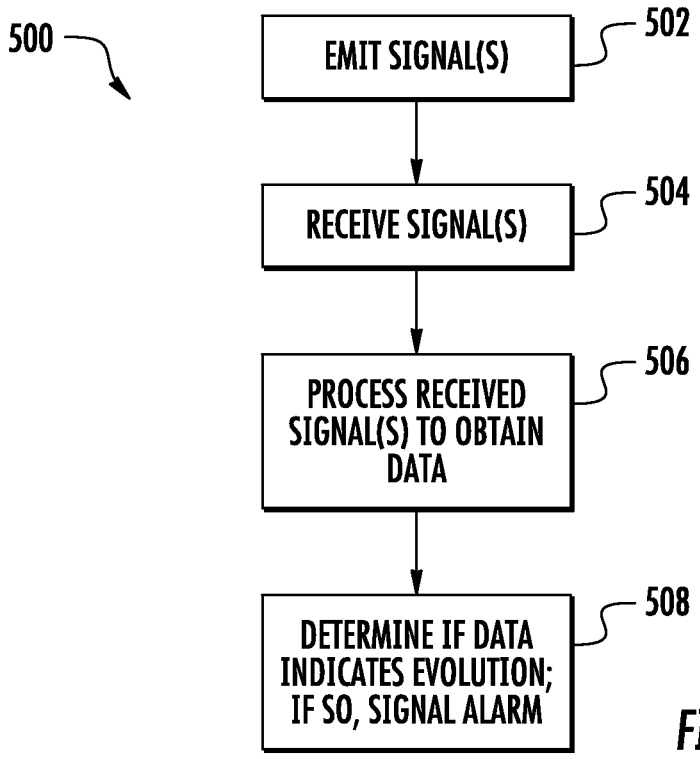
FIG. 5 illustrates a flow chart of an exemplary method.

Turning now to FIG. 5, a flow chart of a method 500 is shown. The method 500 may be operative in connection with one or more environments, systems, devices, or components, such as those described herein. The method 500 may be used to determine the existence or likelihood of the existence of smoke or fire in an area that is actively being monitored, such as a room on the order of a few square meters.

In block 502, one or more signals may be emitted. For example, the emitted signals may take the form of IR light or EM fields. As part of block 502, the area may be characterized, potentially as part of a background or calibration task.

In block 504, one or more signals may be received. The received signals may be based on the signal(s) emitted in block 502. The received signals may be based on, or include, IR light or EM fields. The received signals may be based on a temperature associated with an entity, such as an object or smoke plume.

In block 506, the received signals of block 504 may be processed to obtain data. The processing may include applying a filter or filtering algorithm to the signals or data.

In block 508, the data may be examined to see if, over time, the data aligns with a characteristic profile of how smoke or a smoke plume tends to expand or evolve. If the data aligns with a smoke or smoke plume profile within a threshold amount, an alarm condition may be signaled or provided. A location of smoke in terms of a distance and an angle relative to a reference direction may be provided as part of block 508.

In some embodiments, one or more of the blocks or operations (or a portion thereof) of the method 500 may be optional. In some embodiments, the blocks may execute in an order or sequence different from what is shown in FIG. 5. In some embodiments, one or more additional blocks or operations not shown may be included.

Figure 6:
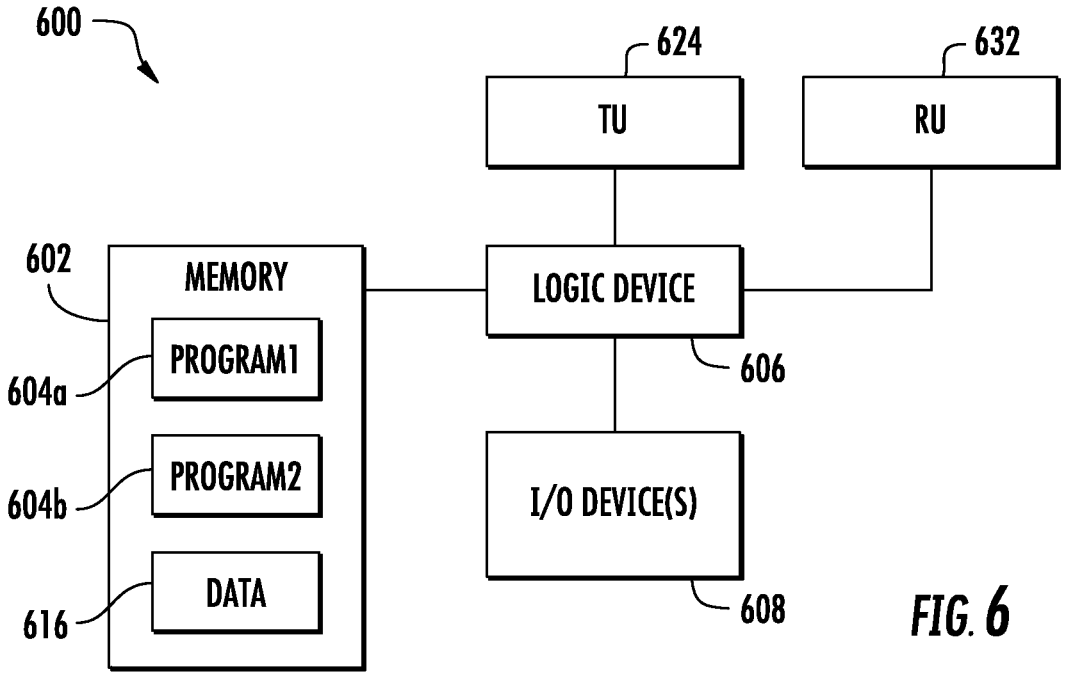
FIG. 6 illustrates an exemplary system for detecting smoke.

Turning now to FIG. 6, a system 600 in accordance with one or more embodiments is shown. The system 600 may be associated with a detector, such as a smoke detector.

The system 600 is shown as including a memory 602. The memory 602 may store executable instructions. The executable instructions may be stored or organized in any manner and at any level of abstraction, such as in connection with one or more applications, processes, routines, methods, etc. As an example, at least a portion of the instructions are shown in FIG. 6 as being associated with a first program 604*a* and a second program 604*b*.

The instructions stored in the memory 602 may be executed by one or more logic devices 606, e.g., a processor, a programmable logic device (PLD) a field programmable gate array (FPGA), etc.

In terms of the use of the logic devices 606, in some embodiments the logic devices 606 may be organized or arranged as a pipeline. For example, in some instances it may be desirable to have an overall time resolution of 1 nanosecond, corresponding to a frequency of 1 GHz. In order to use a low-cost FPGA with a time resolution of 8 nanoseconds, eight such samplers of an FPGA may be arranged in a pipeline, where each sampler may perform a portion (e.g., one-eighth) of the overall work. The metrics provided are illustrative, and any time resolution or number of devices or FPGAs may be used in a given embodiment.

The logic device 606 may be coupled to one or more input/output (I/O) devices 608. In some embodiments, the I/O device(s) 608 may include one or more of a keyboard or keypad, a touchscreen or touch panel, a display device, a microphone, a speaker, a mouse, a button, a remote control, a joystick, a printer, a communications transmitter/receiver, a fire panel, etc. The I/O device(s) 608 may be configured to provide an interface to allow a user to interact with the system 600.

The memory 602 may store data 616. The data 616 may be based on an emission or reception of one or more signals. For example, the system 600 may include an emitter or transmission unit (TU) 624 that may emit or transmit one or more signals and a reception unit (RU) 632 that may receive one or more signals. The data 616 may be indicative of an environment in which the system 600 is located. The data 616 may be processed by the logic device 606 to determine the existence or location of smoke within an area being monitored by the system 600.

The system 600 is illustrative. In some embodiments, one or more of the entities may be optional. In some embodiments, additional entities not shown may be included. For example, in some embodiments the system 600 may be associated with one or more networks. In some embodiments, the entities may be arranged or organized in a manner different from what is shown in FIG. 6.

Embodiments of the disclosure may actively monitor an area. For example, rather than waiting for smoke to reach the proximity of a detector unit or smoke chamber as in conventional systems, aspects of the disclosure may provide for a detector unit that proactively attempts to determine whether smoke is present in an area being monitored by sending light into a protected area. Thus, a time needed to detect the presence of smoke can be reduced, as the impact of smoke transport dynamics on time to alarm are reduced. Furthermore, enhanced accuracy may be obtained in terms of determining a location of a smoke plume within an area that is being monitored.

In accordance with embodiments of the disclosure, a sensor or detector unit might not include a chamber, thereby reducing maintenance and installation costs.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method for monitoring an area, comprising:

emitting, by two emitters a first plurality of signals;

receiving, by at least one sensor, a second plurality of signals, the at least one sensor configured without line of sight to the first plurality of signals;

processing the second plurality of signals to obtain data;

comparing the obtained data to a profile corresponding to an evolution of a smoke plume;

based on the comparison, signaling an alarm condition when an evolution in the obtained data corresponds to the profile within a threshold amount;

tuning a component of the at least one sensor in accordance with a wavelength and frequency, such that smoke is detected and is distinguished from other entities and objects in the area; and rejecting signals caused by ambient light utilizing one or more electronic or software filters, while allowing signals caused by smoke to pass;

wherein the two emitters are configured to emit signals that interfere with each other and are utilized to establish a reference signal value; and wherein the second plurality of signals are compared to the reference signal value to determine whether smoke is present.

2. The method of claim 1, wherein the second plurality of signals comprises scattered infrared (IR) light.

3. The method of claim 1, wherein the second plurality of signals comprises electromagnetic (EM) fields.

4. The method of claim 3, wherein the EM fields comprise non-optical fields.

5. The method of claim 1, wherein the second plurality of signals is based on a temperature of the other entities or objects in the area.

6. The method of claim 1, wherein the at least one sensor does not include a chamber.

7. An apparatus comprising:

memory having instructions stored thereon that, when executed, cause the apparatus to:

emit a first plurality of signals from two emitters;

receive a second plurality of signals from at least one sensor, the at least one sensor configured without line of sight to the first plurality of signals;

process the second plurality of signals to obtain data;

compare the obtained data to a profile corresponding to an evolution of a smoke plume; and based on the comparison, signal an alarm condition when an evolution in the obtained data corresponds to the profile within a threshold amount;

wherein a component of the at least one sensor is tuned in accordance with a wavelength and frequency, such that smoke is detected and distinguished from other entities and objects in the area; and wherein signals caused by ambient light are rejected utilizing one or more electronic or software filters, while allowing signals caused by smoke to pass;

wherein the two emitters are configured to emit signals that interfere with each other and are utilized to establish a reference signal value; and wherein the second plurality of signals are compared to the reference signal value to determine whether smoke is present.

8. The apparatus of claim 7, wherein at least one emitter of the two emitters comprises at least one light emitting diode (LED) configured to emit the first plurality of signals as infrared (IR) light, and wherein the apparatus comprises at least one photodiode configured to receive the second plurality of signals as scattered IR light.

9. The apparatus of claim 7, wherein the second plurality of signals comprises electromagnetic (EM) fields.

10. The apparatus of claim 9, wherein the EM fields adhere to Wi-Fi® standards.

11. The apparatus of claim 7, wherein the second plurality of signals is based on a temperature of the smoke plume.

12. The apparatus of claim 7, wherein the instructions are executed by at least one logic device.

13. The apparatus of claim 7, wherein the instructions are executed by a plurality of logic devices arranged as a pipeline.

14. The apparatus of claim 7, wherein the two emitters and the at least one sensor share a common housing.

* * * * *